US007305096B2

(12) United States Patent
Su et al.

(10) Patent No.: US 7,305,096 B2
(45) Date of Patent: Dec. 4, 2007

(54) DYNAMIC PRESSURE SENSING STRUCTURE

(75) Inventors: Mao-Shun Su, Hsinchu (TW); Tsung-ter Kuo, Hsinchu (TW); Yu-Kon Chou, Hsinchu (TW); Yii-Tay Chiou, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 558 days.

(21) Appl. No.: 11/033,503

(22) Filed: Jan. 12, 2005

(65) Prior Publication Data

US 2006/0078137 A1 Apr. 13, 2006

(30) Foreign Application Priority Data

Oct. 1, 2004 (TW) ..... 93129944 A

(51) Int. Cl.
*H04R 25/00* (2006.01)

(52) U.S. Cl. ..... 381/174; 381/175; 381/191

(58) Field of Classification Search ..... 381/113, 381/116, 355, 369, 173–176, 190, 191; 29/25.41, 29/594; 367/170, 174, 181
See application file for complete search history.

(56) References Cited

U.S. PATENT DOCUMENTS 5,208,789 A 5/1993 Ling
5,452,268 A * 9/1995 Bernstein ..... 367/181
5,740,261 A 4/1998 Loeppert et al.
5,870,482 A 2/1999 Loeppert et al.
6,088,463 A 7/2000 Rombach et al.
7,146,016 B2 * 12/2006 Pedersen ..... 381/175

* cited by examiner

*Primary Examiner*—Huyen Le
(74) *Attorney, Agent, or Firm*—Rabin & Berdo, P.C.

(57) ABSTRACT

A dynamic pressure sensing structure used in a condenser microphone includes an upper electrode plate, a lower electrode plate, a spacer and a substrate, wherein the upper and lower electrode plates are separated by the spacer and form a resonance cavity with the substrate. The upper electrode plate comprises a flat vibration area and a surrounding flexible area connected thereto. The lower electrode plate comprises a sensible electrode and an actuation electrode surrounding the sensible electrode. The plate is in connection with the flexible area so that a capacitor is formed between the sense area and the flat vibration area. The actuation electrode provides a polarization voltage to generate an electrostatic force, thereby attract the flexible vibration area to curve downwards so that the flat vibration area moves in a flat state and a distance between the flat vibration area and the sensible electrode is varied correspondingly.

10 Claims, 4 Drawing Sheets

DYNAMIC PRESSURE SENSING STRUCTURE

BACKGROUND OF THE INVENTION

1. Field of Invention

The present invention relates to a dynamic pressure sensing structure and more particularly to a dynamic pressure sensing structure applied in a condenser microphone.

2. Related Art

In the trend of 'smaller and lighter' in the modem-day markets, micro-electro-mechanical system (MEMS) technologies have been developed to meet these requirements. These MEMS have the advantages of miniature-permitted, batch manufacturing, low cost of used materials and high added values and thus are deemed as the most promising products in the future.

Microphones are dynamic pressure sensors, which may sense very small variations like people's ears to sound. However, human's ears may react to only those sounds having specific frequency ranges owing to the physiological structures of people. Quite the contrary, the microphones with different structures may sense desired sounds with different frequency ranges. However, the traditional microphones generally presented in the market have their limitations in sensing sounds with relatively high frequencies, such as the sound of vibrations of machines of middle frequencies, the closing sound of the heart mitral valves, the sound of turbulence flow of blood in blood vessels and the sound created by the rubbing between bone and ligament.

Silicon crystal microphones are manufactured based on the MEMS technology, which may considerably reduce their manufacturing costs, further miniaturize their volumes and promote their sensitivities. Thus these microphones are quite superior to the traditional microphones. Accordingly, they may be qualified to be applied in industries, medical treatments and environmental protections and the like. The silicon crystal microphones may be roughly classified into piezoelectric microphones, piezoelectric/piezoresistive microphones and condenser microphones. Of the three types of silicon crystal microphones, the condenser silicon crystal microphones have become a main trend since they exhibit higher sensitivities and lower power dissipations.

The condenser microphone comprises a capacitor formed with two electrode plates disposed in parallel and having fillings of air or other insulating materials. The capacitor is connected to a positive end and a negative end of a battery at its two plates respectively to induce a capacitance $C=\epsilon_0\epsilon_r A/d$, wherein $\epsilon_0$ is the dielectric constant in the vacuum, $\epsilon_r$ is the relative dielectric constant of the material disposed between the two plates with respect to the vacuum, A is the area of each of the plates and d is the distance between the two plates. In the capacitor, the distance between the two plates determines the charges stored. That is, the smaller the distance between the two plates is, the more the charges stored in the capacitor are. In a real operation, the principle of the relationship between the distance and the amount of the charges in the capacitor is relied on to obtain a sense output. Specifically, when a sound is directed towards the condenser microphone, an acoustic wave corresponding to the sound has an action on the air and thus the air is compressed, which results in vibration of a diaphragm in the microphone correspondingly. In response thereto, a variation of distance is occurred between the two plates of the capacitor and the charges in the capacitance correspondingly. A sense conversion circuit may acquire this varied capacitance and then a voltage is outputted.

SUMMARY OF THE INVENTION

It is an object of the present invention to provide a dynamic pressure sensing structure used in a condenser microphone, thereby a frequency ranges of the condenser microphone measured may be adjusted and the micro-electro-mechanical system (SEMS) technology may be used in manufacturing thereof so that an improvement structure and a more simple manufacturing process may be concurrently achieved. The dynamic pressure sensing structure comprises an upper electrode plate, a spacer connected to the upper electrode plate and a lower electrode plate located below the upper electrode plate. The lower electrode plate comprises an actuation electrode and a sensible electrode and is separated from the upper electrode plate by the spacer with a predetermined distance and thereby forms a cavity. The upper electrode plate comprises a flat vibration area and a flexible area surrounding and connected to the flat vibration area. When the flexible area is curved downward, the flat vibration area may cause a displacement correspondingly. The lower electrode plate comprises a sensible electrode corresponding to the flat vibration area and an actuation electrode surrounding the sensible electrode. The sensible electrode corresponds to the flexible area so that a capacitor is formed between the sensible electrode and the flexible area. The actuation electrode provides a polarization voltage to generate an electrostatic force and thus attracts the flexible area to curve downwards. Correspondingly, the flat vibration area moves in a flat state and a distance between the flat vibration area and the sensible electrode is varied so that an initial capacitance is formed between the sensible electrode and a flat diaphragm in the microphone.

The measuring frequency ranges of the condenser microphone having the dynamic pressure sensing structure may be varied by adjusting the distance between the sensible electrode and the flat diaphragm by adjusting the voltage between actuation electrode and flexible area on the upper electrode. The microphone has low frequencies for detections of sounds. In addition, the dynamic pressure sensing structure may also be used as a sensing device, such as a manometer.

As compared to the diaphragm device in the prior condenser microphone where a deformed surface of the diaphragm device is approximate to a parabolic surface during the sensing status, the diaphragm(upper electrode) of the invention may be like a plate in outline, due to the creation of the flexible area. Therefore, the dynamic pressure sensing structure according to the present invention has a greater capacitance providing the same area of the diaphragm, and other same settings are given. When the actuation electrode is applied externally with a biased voltage, the upper electrode plate is caused to move downwards. Therefore, the capacitance formed between the upper and lower electrode plates may be different as the bias voltage varies and the biased voltage may also control sensitivity of instantaneous capacitance of the upper and lower electrode. In addition, boundary conditions of the upper electrode plate may change when the actuation electrode is applied externally with a biased voltage. This change may facilitate the movement of the diaphragm along the longitudinal direction due to the variation of the sound pressure of low frequencies and thus be more suitable for measurements of sounds of low frequencies compared to the currently existing sound measurement products. Therefore, the present invention provides the following advantages: 1. A lower cutoff frequency is provided so that a broadened frequency range is obtained. 2. Frequency adjustments are achieved. 3. Sounds of different frequency bands may be measured. 4. A higher sensitivity is achieved. 5. Pressure variations of weak sounds may be effectively detected. 6. Boundary capacitance may be effectively increased. 7. Smaller fundamental frequency is obtained. 8. A simpler outline of the structure is provided. 9. Sound pressure is easier to be balanced.

To enable persons skilled in the art to further understand the objects, features and functions of the present invention, the present invention will be described in more detail with the accompanying drawings, as follows.

BRIEF DESCRIPTION OF THE DRAWINGS

The invention will become more fully understood from the detailed description given hereinbelow illustration only, and thus doesn't limit the present invention, wherein.

DETAILED DESCRIPTION OF THE INVENTION

Figure 1:
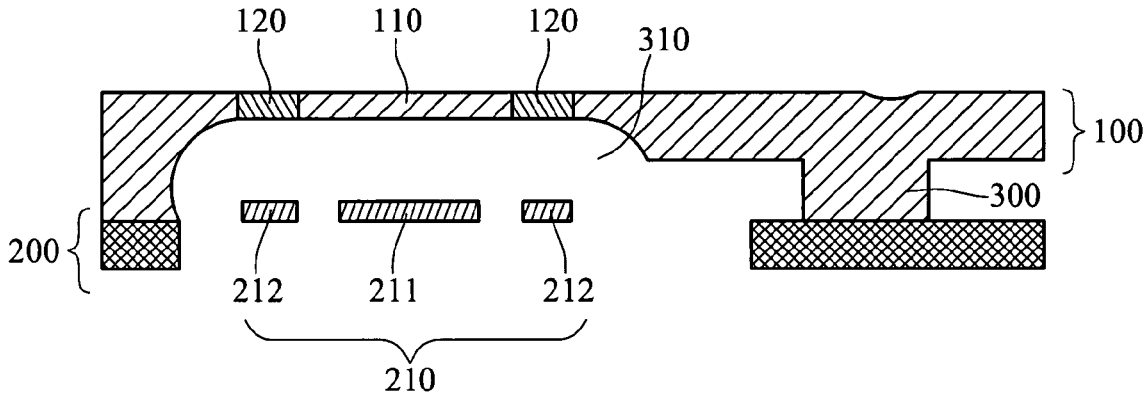
FIG. 1 is an enlarged cross sectional schematic view of a dynamic pressure sensing structure according to an embodiment of the present invention.

FIG. 1 is an enlarged cross sectional schematic view of a dynamic pressure sensing structure according to an embodiment of the present invention. As shown, the dynamic pressure sensing structure comprises an upper electrode plate 100, a spacer 300, a lower electrode plate 210 and a silicon wafer 200. The upper electrode plate 100 is connected to the spacer 300. The silicon wafer 200 comprises the lower electrode plate 210, consisting of a sensible electrode 211 and an actuation electrode 212. The lower electrode plate 210 is disposed below the upper electrode plate 100 and separated there from with a predetermined distance by the spacer 300 and thereby forms a cavity 310 correspondingly. The upper electrode plate 100 comprises a flat vibration area 110 and a flexible area 120 surrounding and connecting the flat vibration area 110. The lower electrode plate 210 comprising the sensible electrode 211 and the actuation electrode 212 is in an annular shape and surrounds the sensible electrode 211. Further, the actuation electrode 212 is in connection with the flexible area 120 so that the sensible electrode 211 may be located in connection with the flat vibration area 110, to form a capacitor there between.

Figure 2A:
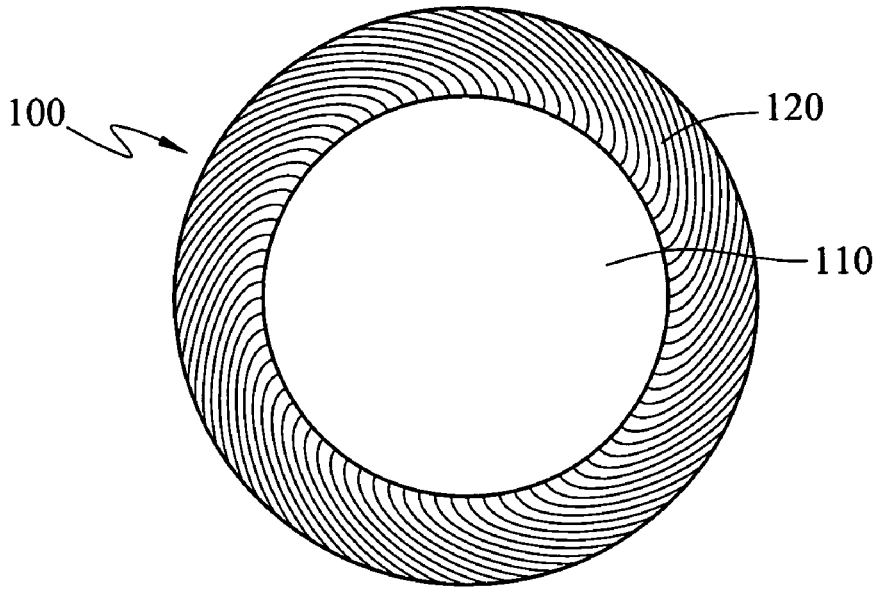
FIG. 2A is a top schematic view of an electrode plate of the dynamic pressure sensing structure according to the embodiment of the present invention.
Figure 2B:
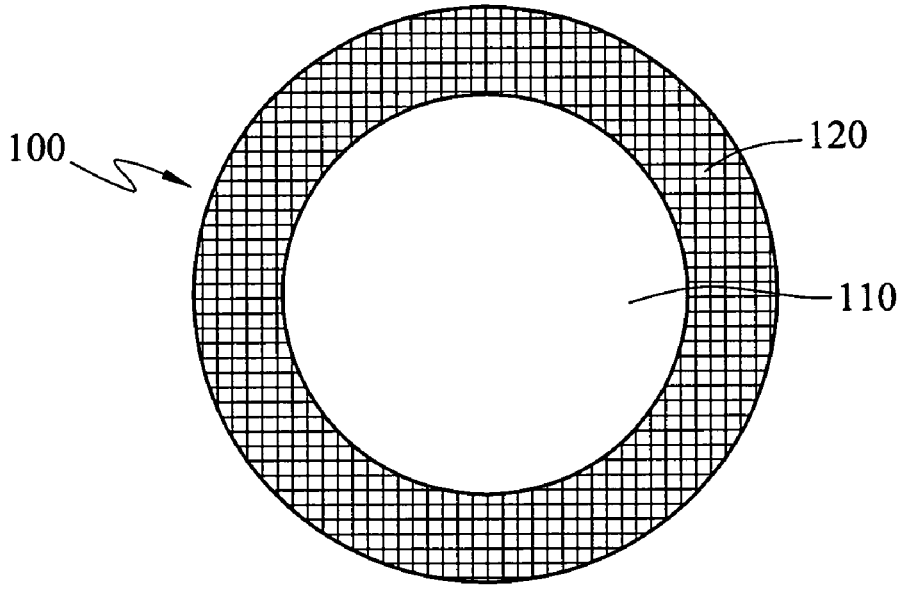
FIG. 2B is a top schematic view of an electrode plate of the dynamic pressure sensing structure according to another embodiment of the present invention.

The upper electrode plate 100 may have a surface having a diaphragm made of a metal or may be a conductive material such as polysilicon blended with $PoCl_3$ of high concentration. The flexible area 120 may contain a plurality of arc-like seams or may be a net-like area so that flexibility may be provided. Referring to FIG. 2A, a top schematic view of an electrode plate of the dynamic pressure sensing structure according to the embodiment of the present invention is illustrated therein. The upper electrode plate 100 comprises a flexible area 120 and a flat vibration area 110. The flexible area 120 contains a plurality of arc-like seams and is located circumferentially in connection with the flat vibration area 110. As shown in FIG. 2B, a top schematic view of an electrode plate of the dynamic pressure sensing structure according to another embodiment of the present invention is illustrated therein. In this embodiment, the flexible area 120 is a net-like area and surrounds the flat vibration area 110.

Figure 3:
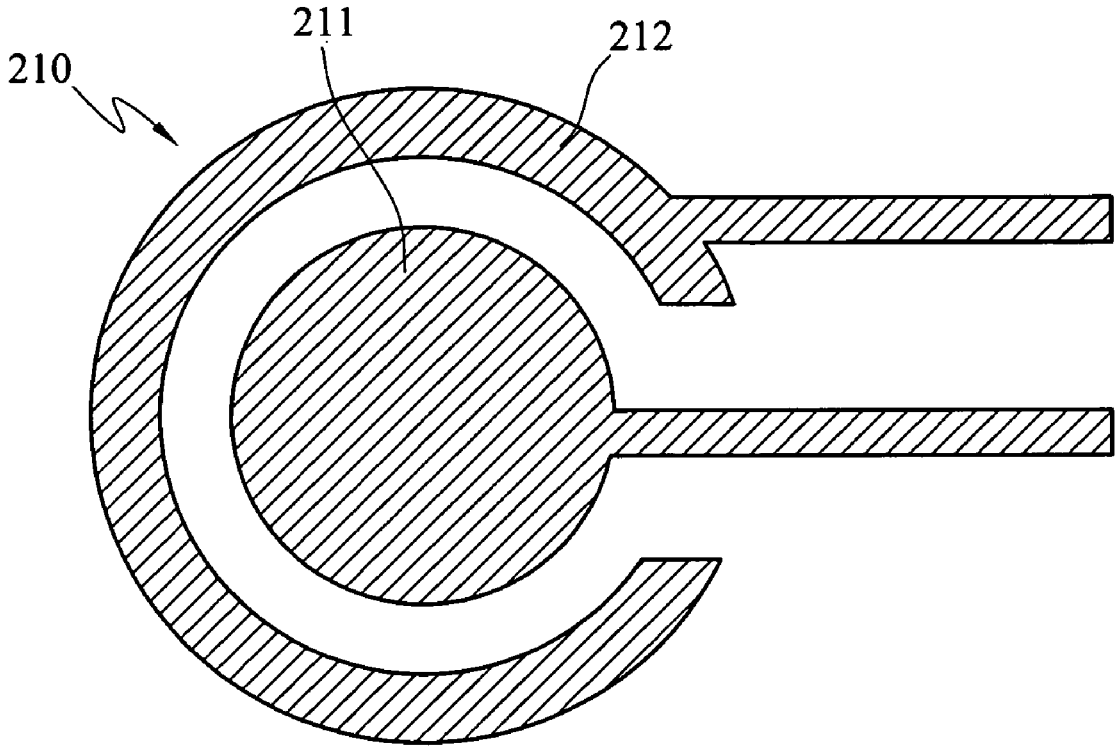
FIG. 3 is a top schematic view of a silicon wafer of the dynamic pressure sensing structure according to the present invention.

The lower electrode plate 210 formed on the silicon wafer 200 comprises an actuation electrode 212 and a sensible electrode 211, in which the actuation electrode 212 is formed to cause a downward movement of the flexible area 120 by generating an electrostatic force to attract the flexible area 120. The sense-electrode 211 is formed to build the capacitor as mentioned above with the flat vibration area 110. Referring to FIG. 3, a top schematic view of a silicon wafer of the dynamic pressure sensing structure according to the present invention is illustrated. As mentioned above, the silicon wafer 200 has a lower electrode plate 210, comprising a sensible electrode 211 and an annular actuation electrode 212 surrounding the sensible electrode 211. Further, an actuation electrode 212 is in connection with the flexible area 120. To attract a downward movement of the flexible area 120, the actuation electrode 212 provides a polarization voltage to generate an electrostatic force. As such, the distance between the flat vibration area 110 and the sensible electrode 211 may be adjusted and an initial capacitance there between may be varied correspondingly.

Figure 4:
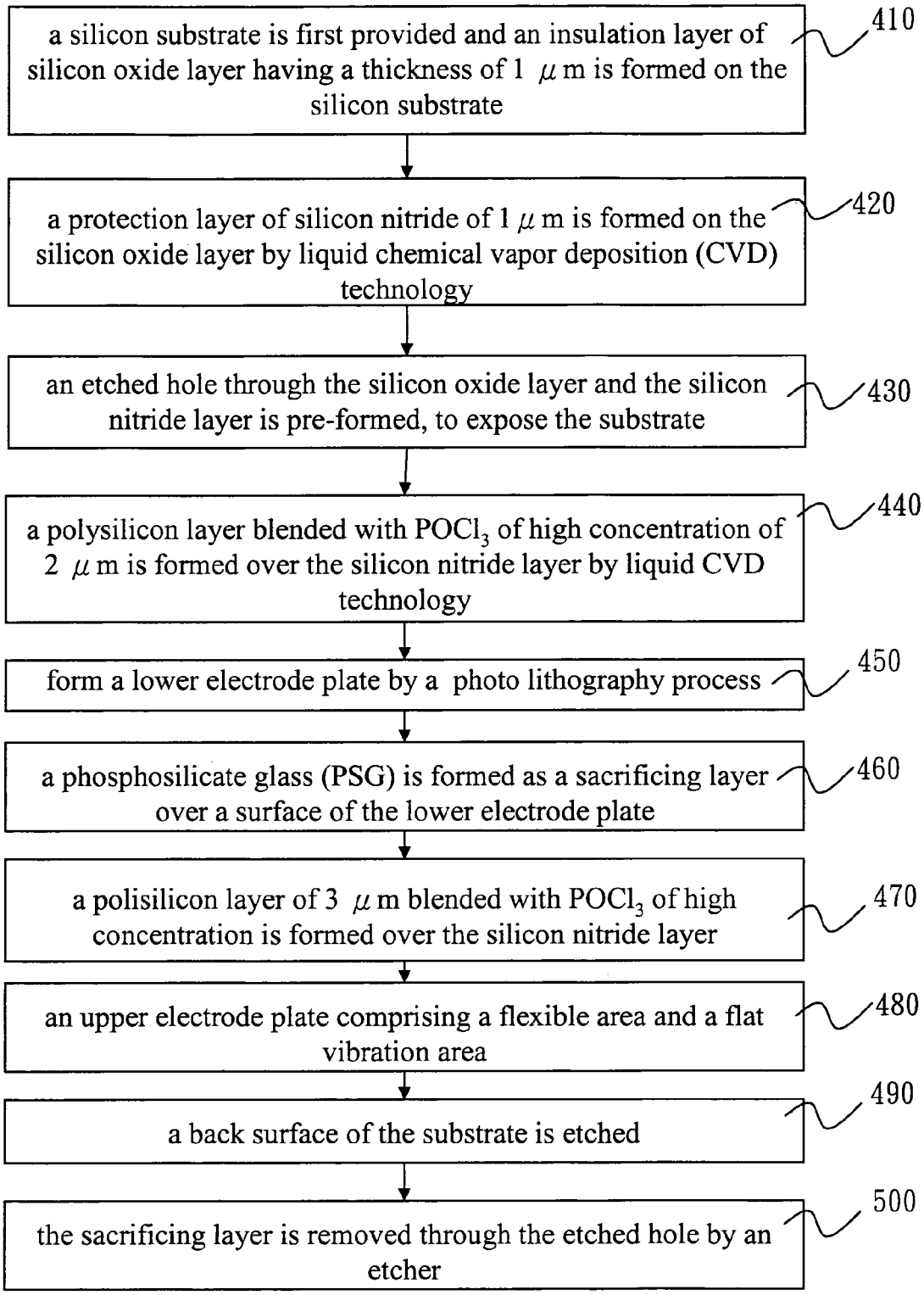
FIG. 4 is a flowchart illustrating a manufacturing process of the dynamic pressure sensing structure according to the present invention.

The dynamic pressure sensing structure may be formed on a semi conductive substrate or other substrates. Referring to FIG. 4, a flowchart illustrating a manufacturing process of the dynamic pressure sensing structure according to the present invention is illustrated therein. As shown, a silicon substrate is first provided and an insulation layer of silicon oxide layer having a thickness of 1 μm is formed on the silicon substrate (step 410). Next, a protection layer of silicon nitride of 1 μm is formed on the silicon oxide layer by liquid chemical vapor deposition (CVD) technology (step 420). Next, an etched hole through the silicon oxide layer and the silicon nitride layer is pre-formed, to expose the substrate (step 430). Then, a polysilicon layer blended with $POCl_3$ of high concentration of 2 μm is formed over the silicon nitride layer by liquid CVD technology (step 440). Then, portions of an actuation electrode, a sensible electrode and circuits are defined as desired, to form a lower electrode plate by a photo lithography process (step 450). Thereafter, a phosphosilicate glass (PSG) is formed as a sacrificing layer over a surface of the lower electrode plate (step 460), wherein the sacrificing layer is opened at a predetermined portion of the spacer 300 to expose the silicon nitride layer. Next, a polisilicon layer of 3 μm blended with $POCl_3$ of high concentration is formed over the silicon nitride layer (step 470). Then, an upper electrode plate comprising a flexible area and a flat vibration area is defined (step 480). Next, a back surface of the substrate is etched (step 490) to remove a portion of the silicon substrate and expose the silicon oxide layer, the silicon nitride layer and the etched hole. Thereafter, the sacrificing layer is removed through the etched hole by an etcher (step 500) so that distance is maintained, between the electrode plate and the substrate, by the spacer.

While embodiments and applications of this invention have been shown and described, it would be apparent to those skilled in the art, having the benefit of this disclosure that more modifications than mentioned above are possible without departing from the inventive concepts herein. The invention, therefore, is not to be restricted except in the spirit of the appended claims and their equivalents.

What is claimed is:

1. A dynamic pressure sensing structure, comprising:

an upper electrode plate comprising a flat vibration area and a flexible area surrounding and connected to the flat vibration area;

a spacer connected to the upper electrode plate; and a lower electrode plate located below the upper electrode plate and separated with the upper electrode plate by the spacer with a predetermined distance and thereby forming a cavity, wherein the lower electrode plate comprises a sensible electrode and an actuation electrode surrounding the sensible electrode and located with respect to the flexible area so that a capacitor is formed between the sensible electrode and the flexible area;

wherein the actuation electrode provides a polarization voltage to generate an electrostatic force to attract the flexible area to curve downwards so that the flat vibration area moves in a flat state and a distance between the flat vibration area and the sensible electrode is varied correspondingly.

2. The dynamic pressure sensing structure of claim 1, wherein the upper electrode plate is a diaphragm having a surface made of a metal.

3. The dynamic pressure sensing structure of claim 1, wherein the upper electrode plate is electrically conductive.

4. The dynamic pressure sensing structure of claim 1, wherein the upper electrode plate is made of polysilicon.

5. The dynamic pressure sensing structure of claim 1, wherein the upper electrode plate is a polysilicon layer blended with $POCl_3$ of high concentration.

6. The dynamic pressure sensing structure of claim 1, wherein the flexible area comprises a plurality of arc-like seams.

7. The dynamic pressure sensing structure of claim 1, wherein the flexible area is a net-like area.

8. The dynamic pressure sensing structure of claim 1, wherein the actuation electrode is annular.

9. The dynamic pressure sensing structure of claim 1, wherein the actuation electrode is a polysilicon layer blended with $POCl_3$ of high concentration.

10. The dynamic pressure sensing structure of claim 1, wherein the sensible electrode is a polysilicon layer blended with $POCl_3$ of high concentration.

* * * * *